US010438463B2

(12) United States Patent
Lovejoy

(10) Patent No.: US 10,438,463 B2
(45) Date of Patent: Oct. 8, 2019

(54) ACCESS CONTROL SYSTEM AND METHOD

(71) Applicant: ASSA ABLOY Residential Group, Inc., New Haven, CT (US)

(72) Inventor: Garrett Lovejoy, Raleigh, NC (US)

(73) Assignee: ASSA ABLOY Residential Group, Inc., New Haven, CT (US)

( * ) Notice: Subject to any disclaimer, the term of this patent is extended or adjusted under 35 U.S.C. 154(b) by 0 days.

(21) Appl. No.: 15/782,208

(22) Filed: Oct. 12, 2017

(65) Prior Publication Data

US 2018/0108228 A1 Apr. 19, 2018

Related U.S. Application Data

(60) Provisional application No. 62/408,416, filed on Oct. 14, 2016.

(51) Int. Cl.

| | |
|---|---|
| ***G08B 13/08*** | (2006.01) |
| ***E05B 45/06*** | (2006.01) |
| ***G08B 29/16*** | (2006.01) |
| ***H01H 13/18*** | (2006.01) |
| ***G08B 25/00*** | (2006.01) |

(Continued)

(52) U.S. Cl.

CPC ..... *G08B 13/08* (2013.01); *E05B 45/06* (2013.01); *G07C 9/00* (2013.01); *G07C 9/00571* (2013.01); *G07C 9/00896* (2013.01); *G08B 25/008* (2013.01); *G08B 29/16* (2013.01); *H01H 13/18* (2013.01); *E05B 2045/0695* (2013.01); *G08B 25/14* (2013.01)

(58) Field of Classification Search

CPC ..... G08B 13/00; G08B 13/08; G08B 29/12; G08B 29/16; G08B 29/18; G08B 29/185; G08B 25/008; G08B 13/196; G08B 13/1966; G06F 21/00; G06F 21/30; G06F 21/32; G07C 2209/04; G07C 9/00; G07C 9/00174; H01H 13/18; E05B 45/06; E05B 17/22; E05C 19/166; Y10T 292/1021; H04N 7/18; H04N 7/186

USPC ..... 340/5.61, 5.82, 506, 541, 542, 545.9; 713/186, 202; 292/144, 251.5

See application file for complete search history.

(56) References Cited

U.S. PATENT DOCUMENTS 5,923,264 A * 7/1999 Lavelle ..... G07C 9/00015 235/375
6,053,546 A * 4/2000 Frolov ..... E05C 19/166 292/144

(Continued)

FOREIGN PATENT DOCUMENTS

WO WO 99/66467 A1 12/1999

OTHER PUBLICATIONS

International Search Report and Written Opinion for International Application No. PCT/US2017/056284, dated Dec. 18, 2017.

*Primary Examiner* — Hung T Nguyen
(74) *Attorney, Agent, or Firm* — Wolf, Greenfield & Sacks, P.C.

(57) ABSTRACT

An access control system cooperates with a security system. The access control system may be used to control aspects of the security system and the security system may be used to control aspects of a lockset used to lock or unlock an access point (e.g., door). A user can choose to arm or disarm the security system via the access control system and similarly the user may choose to lock or unlock the access point via the security system.

23 Claims, 5 Drawing Sheets

(51) Int. Cl.
*G07C 9/00* (2006.01)
*G08B 25/14* (2006.01)

(56) References Cited

U.S. PATENT DOCUMENTS

| | | | | |
|---|---|---|---|---|
| 8,334,785 | B1 | 12/2012 | Zetts | |
| 9,057,210 | B2 | 6/2015 | Dumas et al. | |
| 9,141,150 | B1 | 9/2015 | Trundle et al. | |
| 2002/0133725 | A1* | 9/2002 | Roy | G06K 9/00006 726/5 |
| 2004/0085195 | A1 | 5/2004 | McKibbon | |
| 2006/0090079 | A1 | 4/2006 | Oh et al. | |
| 2009/0184801 | A1* | 7/2009 | Bliding | E05B 49/00 340/5.61 |
| 2013/0027180 | A1* | 1/2013 | Lakamraju | G07C 9/00087 340/5.53 |
| 2014/0263615 | A1 | 9/2014 | DeAngelo | |
| 2014/0365773 | A1 | 12/2014 | Gerhardt et al. | |
| 2015/0143511 | A1* | 5/2015 | Vujic | G06F 21/32 726/19 |
| 2016/0117917 | A1* | 4/2016 | Prakash | G08B 29/185 340/514 |
| 2017/0332055 | A1* | 11/2017 | Henderson | H04N 7/186 |

* cited by examiner

ACCESS CONTROL SYSTEM AND METHOD

RELATED APPLICATIONS

This Application claims the benefit under 35 U.S.C. § 119(e) to U.S. Provisional Application Ser. No. 62/408,416, entitled "VOICE-PROMPTED ELECTRONIC LOCKSET" filed on Oct. 14, 2016, which is herein incorporated by reference in its entirety.

FIELD

Disclosed embodiments relate to an access control system cooperating with a security system.

BACKGROUND

Building alarm systems are employed to provide an added measure of security to a protected space. Typically, such alarm systems include various sensors that detect the presence of persons within the secured space and/or entrance through an access point, such as a door or window. The alarm system also typically includes a control panel allowing a user to arm and disarm the security system. Also, typically access points such as doors include a lock set that is used to secure (i.e., lock) the door to prevent unauthorized access to the secured space whether or not the alarm has been set. These two systems act independent of each other.

SUMMARY

In one embodiment, an access control system that cooperates with an alarm system is provided. The alarm system is configured to detect an unauthorized access into a protected space. The alarm system is controllable between an armed state and disarmed state. The access control system includes a lockset constructed and arranged to change between a locked state and an unlocked state to correspondingly lock or unlock an access point. A lockset controller is in communication with the alarm system and the lockset. A lockset authentication device is in communication with the lockset controller to allow a user to change the lockset between the locked state and an unlocked state upon input of a valid credential to the lockset authentication device. A lockset indicator communicates with the lockset controller. The lockset indicator is constructed and arranged to indicate a state of the alarm system to a user upon input of the valid credential.

In another embodiment, a method of operating an alarm system with an access control system is provided. The alarm system is configured to detect an unauthorized access into a protected space. The alarm system is controllable between an armed state and disarmed state. The access control system includes a lockset, a lockset controller in communication with the alarm system, a lockset authentication device in communication with the lockset controller and a lockset indicator communicating with the lockset controller. The method includes entering a valid credential in the lockset authentication device to allow the lockset to be changed between a locked state and an unlocked state to correspondingly lock or unlock an access point, and receiving an indication as to the state of the alarm system upon entry of the valid credential.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
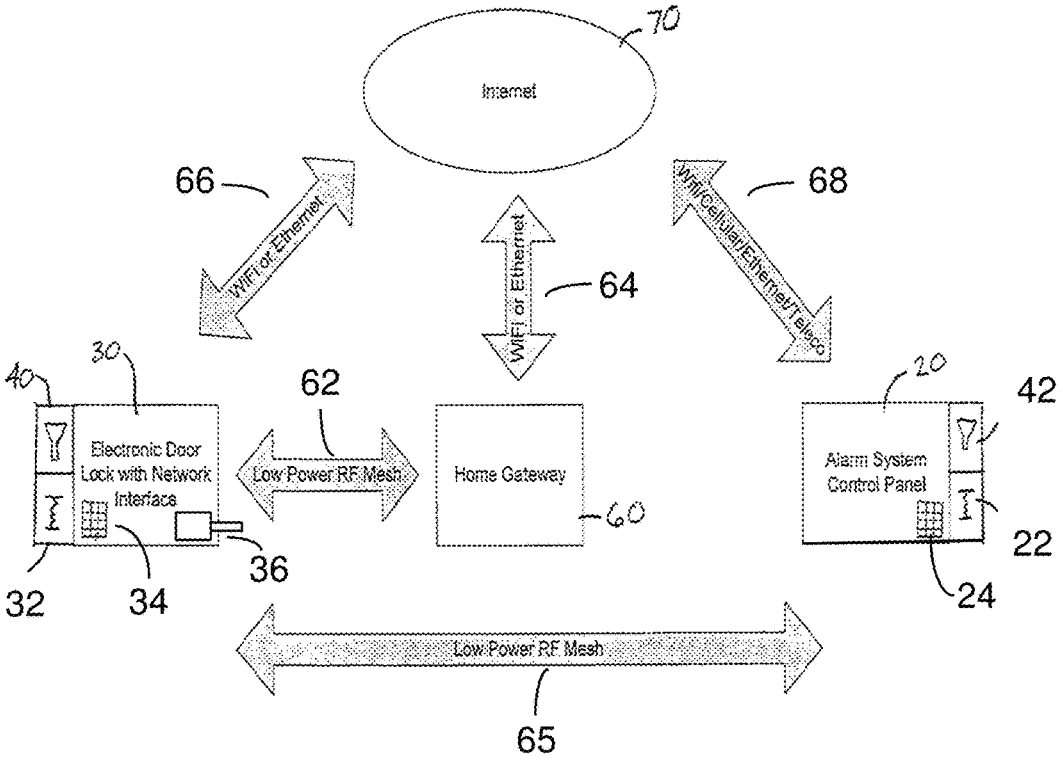
FIG. 1 is a schematic view of one embodiment of an access control system, including a lockset, communicating with an alarm system.

The present disclosure relates to an access control system cooperating with a security system (also referred to as an alarm system), and a method of using the access control system. The access control system may be used to control aspects of the security system and the security system may be used to control aspects of the access control system. In this way, a user can choose to arm or disarm the security system via the access control system and similarly the user may choose to lock or unlock an access point (e.g., door) via the security system.

In some cases, an access control system may be referred to herein as a lockset system, such as a lockset system for locking a door. However, the present disclosure is not limited to a particular lockset, and may include any suitable structures for restricting access through an access point. It should be appreciated then that the terms "access control system" and "lockset system" may be used interchangeably.

The access control system may include a lockset that includes a latch, deadbolt, or some other locking device may be used to secure a protected space. The locking device may be activated manually by a key, may utilize some kind of electronic authentication device, or may employ some other conventional system or method to lock or unlock the locking device. The lockset may be manual, wherein the locking device is physically actuated between a locked and unlocked position by the user or actuated by some other physical structure (e.g. biasing member). Alternatively, the lockset may be electronic, wherein the locking device is actuated by an electronic actuator (e.g., motor, electromagnet, etc.) between a locked and unlocked position. In some cases, a protected space may be further secured by an alarm system. Traditionally, these alarm systems may be configured to detect an unauthorized entry into a protected space and subsequently notify the relevant authorities. In some cases, an authorized user may forget to disarm the alarm when entering a protected space, thereby triggering an undesirable false alarm in which authorities are notified even for an authorized entry. Similarly, an authorized user may forget to arm the alarm system when exiting a protected space, compromising the additional security afforded by the alarm system. Accordingly, the present disclosure relates to the cooperation of an access control system with an alarm system such that an authorized user may be reminded of the alarm system state by the access control system and may choose to change the state of the alarm system based on that reminder. By indicating the state of the alarm system, such a system may reduce false alarms and/or increase the utilization of an alarm system in a protected space. Also, the user may optionally choose to lock or unlock the access point to the protected space via the alarm system. It should be appreciated herein that the terms "alarm system" and "security system" are used interchangeably.

The inventors have appreciated numerous benefits associated with access control systems that prevent false alarms by notifying an authorized user of a state of an associated alarm system. For example, the user may forget the state of an armed alarm system installed in a protected space and inadvertently cause a false alarm by entering or exiting the protected space. Moreover, many alarm systems provide no indicators as to the state of an alarm system at a point of egress or ingress for a protected space. Accordingly, the inventors have appreciated that an access control system may reduce the occurrence of false alarms by providing an authorized user an indication as to the state of the alarm system at the point of egress or ingress for a protected space. In this manner, an access control system and cooperating alarm system may reduce the number of inadvertent false alarms caused by an authorized user by reminding the user of an alarm system state prior to the user entering the protected space, that is, upon unlocking the access point. Furthermore, such access control systems may allow an alarm system to be armed more frequently without a corresponding increase in false alarms. That is, such access control systems provide the ability to arm the security system when the user is exiting the protected space and locking the access point (door). Such a notification or indication may be in the form of a visual, auditory or haptic indication to an authorized user as to the state of an associated alarm system installed in a protected space. It should be appreciated that the various embodiments disclosed herein may be described with respect to a door being the access point; however the invention is not so limited as other access points (such as windows, hatches, and any other physical or arbitrary boundaries delimiting one space from another) may be utilized.

The inventors have also recognized the numerous benefits of an access control systems that notifies an authorized user of a state of an associated alarm system and further prompts the user to change the alarm system state. For example, such an access control system may include a visual, auditory, or haptic indicator that provides a visual, auditory, or haptic indication to an authorized user as to the state of an associated alarm system, and subsequently prompts the user to allow the user to change the state. In this manner, the access control system may prompt an authorized user to change the state of the alarm system before entering or exiting so that a false alarm can be avoided. In some cases, an authorized user may forget the state of an alarm system and wish to change it upon notification of an alarm system state. For example, an authorized user leaving a protected space may have forgotten the alarm system state and wish to arm the alarm system upon notification of a disarmed state. Accordingly, the inventors have appreciated that an access control system capable of notifying an authorized user of an alarm system state and further prompting the user to change the alarm system state by utilizing the access control system instead of directly at the alarm system may prevent false alarms or otherwise increase the use of the alarm system.

The inventors have also recognized it may be desirable for a user to receive a prompt from an alarm system to change the state of a cooperating access control system (i.e. lockset system). For example, the alarm system may provide a visual, auditory, or haptic indication to the user as to the state of a cooperating lockset system, and subsequently prompt the user, allowing the user to change the state of the lockset system. For example, suppose the user is remaining in the protected space and has set the alarm to a "stay" mode but forgot to lock the door. According to this embodiment, the alarm system would prompt the user to lock the lockset system upon setting the alarm so that protected space may be better secured. Accordingly, the inventors have appreciated that an access control system capable of receiving commands from an alarm system indicating the lockset system state to the user and further prompting the user to change the lockset system state may improve the security of the protected space. The prompt may further be dependent on one or more state conditions of the lockset system and alarm system. For example, the indicator may prompt the authorized user to arm the alarm system when the lockset system is in a locked state and the alarm system is in a disarmed state, whereas the indicator would not prompt the authorized user to arm the alarm system when the lockset system is in a locked state and the alarm system is in an armed state. Similarly, the indicator may prompt the authorized user to disarm the alarm system when the lockset system is in an unlocked state and the alarm system is in an armed state, whereas the indicator would not prompt the authorized user to disarm the alarm system when the lockset system is in an unlocked state and the alarm system is in a disarmed state. While some examples are disclosed herein, any suitable combinations of pre-defined lockset and alarm system states may be employed to prompt the user by an indicator to change the state of the lockset system and/or alarm system.

As noted above, according to one aspect of the present disclosure, the lockset system may include at least one of a visual, auditory, and haptic indicator configured to indicate a state of the lockset system and/or a cooperating alarm system to an authorized user. In some embodiments, the indicator may be a speaker. The speaker may be configured to produce an auditory signal that indicates the state of the lockset system and/or a cooperating alarm system. In some cases, the auditory signal may be configured to be a tone or chime, wherein a particular tone or chime corresponds to a particular state of the lockset system and/or alarm system. Such an arrangement may allow an authorized user to quickly and accurately receive the state of the lockset system and/or alarm system, without requiring the user to look in a particular area for indication. In some embodiments, the auditory signal may be configured as a pre-recorded voice. Such an arrangement may improve the clarity of state indication to an authorized user, as the state of a lockset system and/or alarm may be communicated to the user in the native language of the user. By producing an auditory indicator, the lockset system indicator may notify an authorized user without additional action by the user.

In some embodiments, the indicator may be configured as a visual indicator. For example, the indicator may be a light. In some cases, an authorized user may wish to prevent a lockset system and/or alarm system state from being revealed to an unauthorized user. Accordingly, a visual indicator may better prevent the emitting of an alarm system state to an unauthorized user. For example, a small LED light on the lockset system may be hard to discern at a distance, and may be easily coverable by the authorized user operating the lockset system. In such arrangements, the visual indicator on the lockset may have a particular appearance (e.g., color, blinking pattern, text, icon, etc.) corresponding to a particular state of the lockset system and/or cooperating alarm system. In some embodiments, the visual indicator may be configured as a text or icon display. In this configuration, the lockset system may display codes or icons relating to a particular state of the lockset system and/or cooperating alarm system. The visual indicator may be disposed on the lockset system itself or the lockset system may communicate with a remote device (e.g., smartphone) to provide the indication to the user. Also, as the present disclosure is not limited, a light may be disposed on the lockset system but the light may be beamed from the lockset system and projected onto a surface at a location remote from the lockset.

In some embodiments, the indicator may be configured as a haptic indicator. For example, the indicator may be a vibrating device. In some cases, an authorized user may wish to receive haptic indication from the lockset system as to the alarm system state. Accordingly, the haptic indicator may provide such an indication without necessitating auditory or visual attention to the indicator. In some embodiments, the haptic indictor may vibrate in a particular pattern, sequence, or manner by modifying intensity, duration, or other characteristics thereof. For example, the haptic indicator may vibrate twice for an armed security system state and vibrate once for an unarmed security system state. The haptic indicator may be disposed on the lockset system itself or the lockset system may communicate with a remote device (e.g., smartphone) on which the haptic indicator is disposed to provide the haptic indication.

In some cases, the authorized user may wish to prevent revealing the state of the alarm system by the lockset system to an unauthorized user. Accordingly, the indicator may be arranged to only indicate to an authorized user following the verification of a valid credential. For example, the indicator may only indicate the state of the lockset system and/or cooperating alarm system when the authorized user successfully unlocks the door using a conventional key or access code. By preventing an unauthorized user from receiving a lockset system and/or alarm system state, the lockset system may increase the security of a protected space. In some embodiments, the lockset system may include an authentication device by which an authorized user can control the lockset system and/or a cooperating alarm system. The authentication device may use any suitable means to validate the credentials of an authorized user (e.g., RFID scanner, physical key, PIN/access code, password, biometric scanner, etc.). The authentication device may further allow a user to receive the visual, auditory, or haptic indication as described above.

According to another aspect of the present disclosure, the lockset system may include a controller configured to communicate with an alarm system in an attached protected space. In some cases, it may be desirable to for the lockset system to communicate with an alarm system in an attached protected space via a wireless connection. Thus, in some embodiments, the controller may be include a wireless transceiver. For example, the lockset system may employ an RF chip configured to transfer data to a cooperating chip in the alarm system, simplifying installation and operability. While an RF chip is described in the present embodiment, any suitable means for connecting the lockset system to the alarm system may be employed, including but not limited to Wi-Fi, Bluetooth, ZigBee, Z-wave, etc.

In some cases, it may be desirable for the lockset system, such as through the associated controller, to cooperate with the alarm system via the Internet in order to allow an authorized user remote access to a lockset system and/or alarm system state. In such an arrangement, an authorized user could use a user device (e.g., smartphone, personal computer, etc.) to access state information regarding the lockset system and/or alarm system. Furthermore, the Internet-connected controller may be further configured to send auditory, visual, or haptic indications to the user device when an indication from the lockset system is generated. For example, an authorized user may receive a notification remotely on a user device that a lock on a door to a protected space was or is locked or unlocked and the associated alarm system state at that time. Accordingly, the user may receive the indication of a lockset system and/or alarm system state on the user device. In some embodiments, the authorized user may further be able to configure the lockset system and/or alarm system from the user device. In this arrangement, the lockset system may be configured to receive commands from the user device, wherein the commands change one or more states of the lockset system and/or cooperating alarm system. For example, an authorized user may wish to arm the alarm system upon receiving a notification from the lockset system of a disarmed state, and may be able to send a command via the user device to arm the cooperating alarm system. In some embodiments, at least one of an indicator and authentication device of the lockset system may be disposed on the remote user device, and be further configured as a graphic user interface (GUI). For example, the indicator and authentication device may be a GUI as integrated with a smartphone application.

According to another aspect of the present disclosure, the lockset system may include a lockset with a deadbolt or other locking device arranged to prevent the opening of a door on which the lockset system is installed. In this arrangement, the position of the deadbolt in either a locked or unlocked position may correspond to a locked or unlocked state of the lockset system. In some cases, it may be desirable to indicate the state of the lockset system and/or cooperating alarm system when the position of the locking device is altered. For example, an authorized user may receive the state of a cooperating alarm system when the locking device in changed from the locked to the unlocked position to alert the authorized user if a possible false alarm could occur. In this illustrative example, the authorized user may be notified of an armed alarm system state before opening the door which may trigger a false alarm. In a similar example, the authorized user may lock the lockset and receive a disarmed state of the cooperating alarm system. Accordingly, the authorized user may wish to arm the system to fully secure the protected space. As described above, such arrangements may reduce the frequency of unwanted indications of the lockset system and/or alarm system state by requiring a protecting or unprotecting action to be taken on the part of an authorized user at the lockset. As used herein, a protecting action will be any action taken by an authorized user to secure a protected space (e.g., locking the lockset, arming the alarm system, etc.) and an unprotecting action will be any action taken by said user to make the protected space less secure (e.g. unlocking the lockset, disarming the alarm system, etc.).

In some embodiments, the lockset system may be used to control various settings of not only the lockset system itself but of the alarm system instead or in addition. Similarly, the alarm system may be used to control various settings of not only the alarm system itself but of the lockset system instead or in addition. Furthermore, the authentication device may allow the user to access settings for the lockset system and/or cooperating alarm system.

Turning now to the figures, FIG. 1 shows a schematic view of one embodiment of an access control system 30 as integrated with an alarm system 20 in communication with each other via the Internet 70. The access control system 30 includes a lockset controller 32, a lockset 36, and a lockset authentication device 34, such as a keypad or remote user device. The keypad, if employed, may be a physical push-button keypad or may be implemented as a touch screen on or adjacent to the lockset, as the present disclosure is not limited in this regard. The alarm system 20 also includes a controller 22 communicating with a control panel 24. The lockset controller 32 communicates with the alarm system 20 first through a Wi-Fi or cable Ethernet connection 66 via a router 70 connected to the Internet. The alarm system controller 22 communicates with the access control system 30 first through a Wi-Fi, cellular, telephone line, coaxial cable, fiber optic cable, Ethernet cable connection or any other suitable communication connection 68 via a router 70 connected to the Internet. Alternatively or in addition, a low power home gateway 60 utilizing RF mesh systems 62 such as Zwave or Zigbee may be used for two-way connection with the access control system 30 and a WiFi or Ethernet connection 64 with the Internet. In another embodiment, rather than employing a home gateway 60, the access control system and alarm system may communicate directly via a low power RF mesh 65. Access control system 30 may receive commands from the alarm system to lock or unlock a door (not shown in the figure), and in turn transmits a state of the various latches and/or deadbolts in the lockset to the alarm system 20. The state transmitted by the access control system may pertain to whether a deadbolt or latching device is engaged and locked, or disengaged and unlocked. Similarly, the access control system is configured to receive a state of the alarm system 20 via the controller 50. Furthermore, the access control system may be configured to provide commands to the lockset to lock or unlock the door, and/or commands to the alarm system to arm or disarm the alarm system. In the embodiment shown in the figure, the access control system comprises one or more indicators 40 that prompt an authorized user to arm or disarm the alarm system, and/or alert the user of the state of the access control system and/or the alarm system when a protecting or unprotecting action occurs. Further, in the depicted embodiment, the alarm system includes one or more indicators 42 that prompt an authorized user to lock or unlock the lockset, and/or alert the user of the state of the access control system and/or the alarm system when a protecting or unprotecting action occurs.

Figure 2:
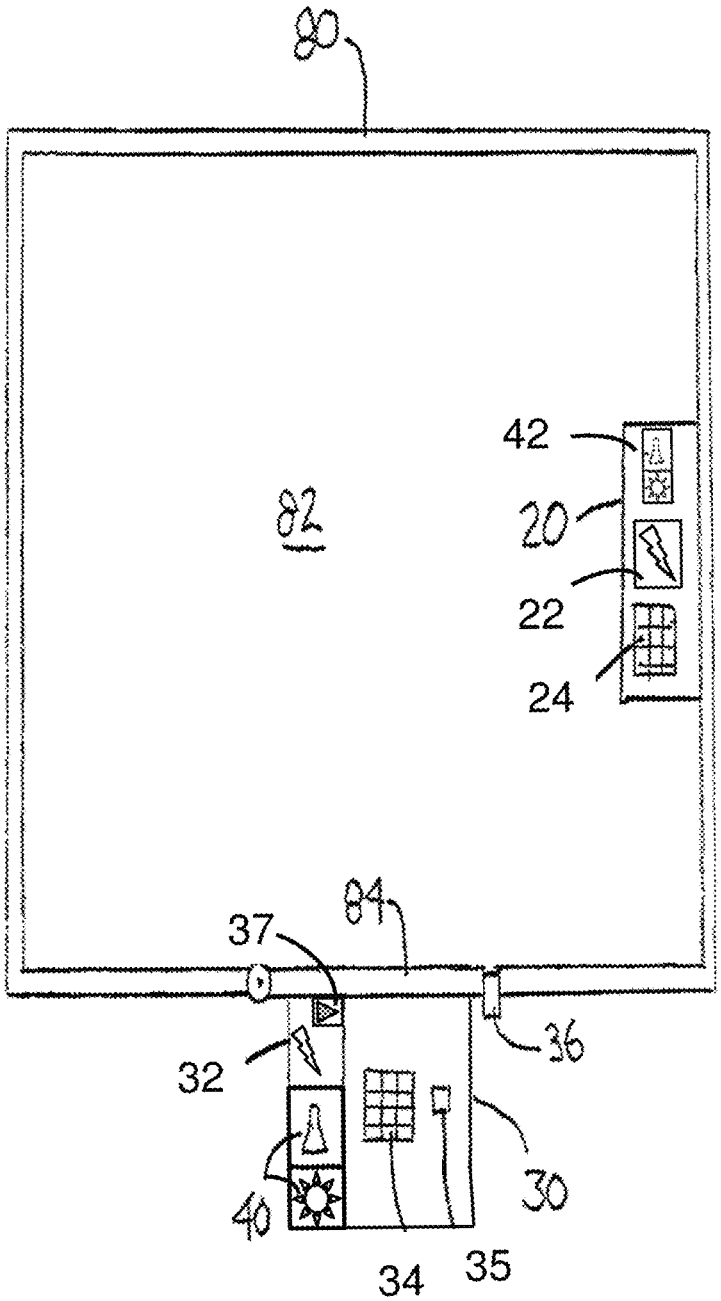
FIG. 2 is a plan schematic view of one embodiment of at least a portion of the system shown in FIG. 1; and, FIG. 3-5 are flowcharts of various embodiments of methods for operating the system shown in FIG. 1.

FIG. 2 depicts a schematic view of an access control system 30 including an indicator 40. In the depicted embodiment, the access control system is installed on a door 84 adjoining a protected space 82 within building 80. The access control system 30 further includes a keypad 34 acting as the authentication device and, optionally, a one-touch locking button 35, as well as the indicator 40 (which may be at least one of an auditory, visual and haptic indicator), and associated controller 32. In some cases, it may be desirable to allow the door to be locked without authorization. Accordingly, the one-touch lock button or icon 35 may allow the user to lock the door with a single press without the need to verify credentials by the keypad 34. The protected space is secured by a cooperating alarm system 20 that is configured to detect unauthorized access into the protected space. The access control system cooperates with the building alarm system 20. The building alarm system 20 provides an alarm if the system is initially armed and is not disarmed within a preset initial time period of detecting unauthorized access. The alarm system may be active when armed in one or more zones or portions of the building interior. The alarm system 20 is controllable between an armed or disarmed state by a control panel 24 configured as a keypad 22. A user in the building may enter a valid personal identification number (PIN) code or password via the keypad 22, to determine whether the alarm system is in an armed or disarmed state and to actually arm or disarm the alarm system. The alarm system may contain conventional circuitry to receive the entered credential, compare the entered credential to valid credentials in the system, determine whether the entered credential is valid, and then perform the arming or disarming indicated by the credential entry. Though a keypad is described, other suitable authentication devices for the alarm system may be employed, such an RFID card, mobile phone identifier, fingerprint reader, iris scanner and/or facial recognition scanner.

In the present embodiment, the access control system includes a lockset controller 32 in communication with the building alarm system 20 and a lockset 36 including a locking device. Lockset controller 32 includes hardware, firmware and/or software for executing the methods described herein. The system may be hard-wired into the alarm system, or wireless connection methods as described above may be used for triggering and for the other inputs and outputs described above. The lockset controller may be externally powered via a power input and/or a battery which may be provided to operate the voice alert system in case power is lost or if a wired power input is undesirable. The lockset controller 32 includes a storage device 37 that stores the program that can cause the auditory, visual or haptic indication.

In some embodiments, the storage device 37 may be configured to store one or more voice signals. The one or more voice signals may be a pre-recorded or simulated voice reciting phrases or words as described herein. The words or phrases may relate to a state of the access control system and/or alarm system and any associated prompts concerning to changing said state. The storage device may be constructed and configured as a data storage device, which may be flash memory, read only memory, or any other suitable form of digital or analog storage suitable for storing a voice signal. In some embodiments, the storage device may be configured to retain the data stored within when unpowered, as in the case of a power loss. The memory may be a true storage of the voice signal, or it may include instructions for creating a synthetic voice comprising the desired wording. The voice signal may be in any language and may repeat the words in multiple different languages suitable for a country or region where the system may be installed.

According to the present embodiment, the indicator 40 may include an auditory indicator constructed as a speaker or other suitable device for producing an auditory signal. In some embodiments, the speaker may audibly emit a voice signal, tone, or chime selected and retrieved by the controller to a user adjacent the exterior side of door 84, opposite the protected space 82. An auditory indicator may include one or more speakers internal or external to the protected space 82 and connected to the controller for emitting an audible signal. In some embodiments, the auditory indicator may emit a tone or chime corresponding to a state of the access control system or alarm system. For example, the auditory indicator may emit a unique tone or chime for each unique state of the access control system and/or alarm system. In some embodiments, the indicator may primarily emit voice signals. In this embodiment, the lockset controller 32 retrieves the voice signal from the storage device and sends the voice signal to the indicator when required under the circumstances described herein. The voice signal or message may be set at any suitable volume to reach from the speaker(s) to an authorized user's location at one or more locations in or outside the protected space.

In some embodiments the lockset controller 32 is configured to lock or unlock the lockset 36 or arm or disarm the alarm system 20 via input of a valid credential at the keypad 34. In one embodiment, the lockset 36 may include a motorized deadbolt that automatically retracts or deploys upon entry of the valid credential. In another embodiment, the lockset 36 becomes manually actuatable upon entry of the valid credential. Additionally, upon entry of a valid credential at the door authentication device, the controller is configured to retrieve a voice signal from the storage element and send the voice signal to the speaker to audibly emit the voice signal containing words indicating whether the alarm system is armed or disarmed, whether the alarm system should be armed or disarmed, whether a user may arm or disarm the alarm, and/or any other suitable attribute relating to the state of the access control system and/or alarm system. The access control system may operate to provide the audible voice prompts or indications to the user at the location of the door under one or more of the scenarios discussed herein.

In some embodiments, the indicator 40 may include a visual indicator to be used instead or in addition to the audible indicator. The visual indicator may include one or more lights, which may indicate the state of the access control system 30 or alarm system 20 by illuminating, changing color, blinking or any other suitable appearance. The visual indicator may be any suitable device for relaying visual information to an authorized user. The visual indicator may comprise one or more lights or displays utilizing conventional light emitting diode (LED), liquid crystal display (LCD), or other display technology. For example, the visual indicator may include or more multicolor LEDs configured to emit a particular color corresponding to a state of the lockset or alarm system. Similarly, the visual indicator may include one or more multicolor LEDs configured to flash a particular pattern corresponding to a state of the access control system or alarm system. In this example, the LED may blink at regular or intermittent intervals in a pre-defined pattern corresponding to a particular state of an access control system or alarm system. In some cases, it may be desirable for the visual indicator to convey more information than color or pattern can accurately convey. Accordingly, the visual indicator may consist of a display configured to show text or icons corresponding to a state of the access control system or alarm system. For example, the display might show the text "ARMED" if the alarm system 20 is armed or "DISARMED" if the alarm system is disarmed. Similarly, a visual indicator may show the text "LOCKED" if the lockset 36 is locked and the text "UNLOCKED" if the lockset is unlocked. Any suitable text or icon relating to a particular state of the lockset system and/or alarm system may be employed. The visual display may be disposed on the access control system itself or as discussed above may be beamed to a remote surface. The visual display may also or alternatively be displayed on a remote computing device such as a smartphone or computer.

In some embodiments, the indicator 40 may include a haptic indicator employed instead or in addition to the audible and/or visual indicator. The haptic indicator may include one or more vibrators, which may indicate the state of the access control system 30 or alarm system 20 by vibration. The haptic indicator may be disposed on or adjacent the lockset and may also or alternatively be actuated on a remote computing device such as a smartphone or computer.

In one embodiment, the indicator 40 may be made to indicate the state of the access control system 30 and/or alarm system 20 upon locking or unlocking the lockset 36 or arming or disarming the alarm system 20. For example, the lockset may be locked and the alarm system in an armed state and an authorized user may unlock the lockset, thereby triggering the indicator to indicate the armed state of the alarm system to the authorized user. Furthermore, the indicator may be configured to prompt the user to change the state of the unmodified system. According to the present example, the indicator may prompt the user to disarm the system following notification of an armed state. In some embodiments, the user may be able to alter the state of the unmodified system through the authentication device on the access control system and/or alarm system. In other embodiments, the user may use any suitable arrangement for answering the prompt from the indicator. For example, the authentication device(s) 34, 24 may comprise a keypad by which a user can respond to a prompt and cause the change of the state of the access control system and/or alarm system. In another illustrative example, the access control system 30 may be in an unlocked state and the alarm system 20 in a disarmed state and an authorized user may lock the lockset, thereby triggering the indicator to indicate the unarmed state of the alarm system 20. Furthermore, the indicator may prompt the user to arm the alarm system 20, and allow the user to do so from the access control system 30 by the authentication device 32 or some other suitable element.

In some cases, it may be desirable to change the state of the access control system 30 from the alarm system 20. Accordingly, the alarm system may include a visual, auditory, or haptic indicator configured to indicate the state of the access control system upon a change in the state of the alarm system and subsequently prompt the user to lock or unlock the lockset 36. For example, the access control system may be in an unlocked state and the alarm system in an unarmed state when an authorized user arms the alarm system, triggering an indication of the unlocked state of the access control system, and subsequently prompting the user to lock the lockset. Accordingly, the user may be able to respond to the prompt via an authentication device 22 or any other suitable element of the alarm system 20. While some examples of indication and prompting are disclosed herein, any suitable combination of lockset system and/or alarm system states may be indicated or modified as a part of the present disclosure.

Figure 3:
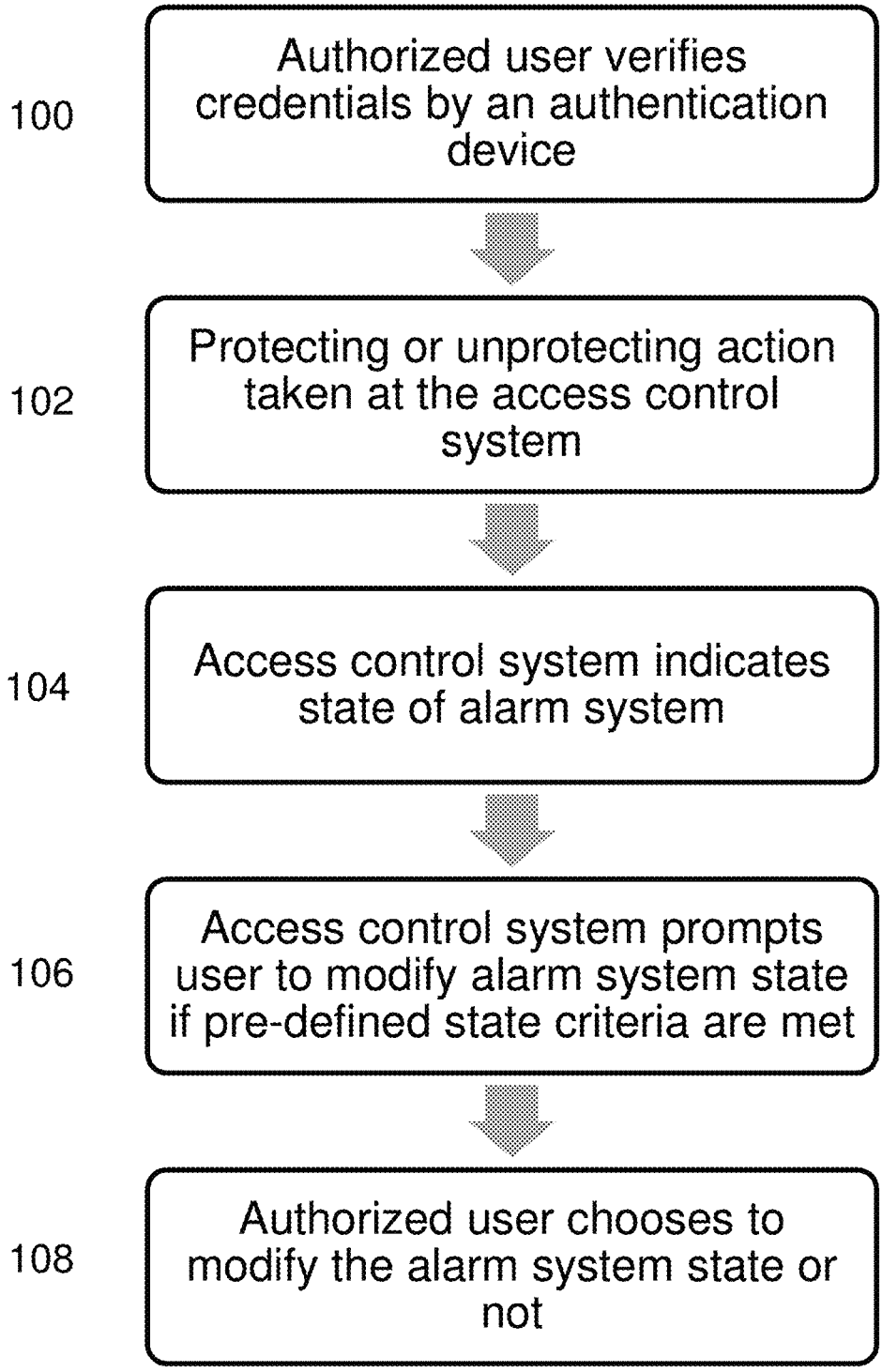

FIG. 3. is a flow chart of one embodiment of a method for operation of the lockset system. In this embodiment, at box 100, the authorized user first enters credentials at an authentication device on the lockset system. As noted above, the authentication device may be configured as a keypad, RFID scanner, biometric scanner, or keyhole or any of the other authentication devices identified above, such that the system will only accept valid credentials to allow an authorized user to enter the protected space. After authorization by the authentication device, at box 102, the user may take a protecting or unprotecting action at the access control system (e.g. locking or unlocking the lockset or arming or disarming the alarm system). Following a protecting or unprotecting action, at box 104, the access control system may indicate the state of the alarm system to the user by a visual, auditory, or haptic indicator. Subsequently, at box 106, the access control system may prompt, via the visual, auditory, or haptic indicator, the user to change the state of the alarm system if certain pre-determined criteria are met. Then, at box 108, the authorized use may choose to change the alarm system state using the access control system, or leave the alarm system state unmodified.

In some embodiments, the indicator may only indicate the state of an access control system and/or alarm system if certain conditional criteria regarding the state of the access control system and/or alarm system are met. In some cases, the indicator may only indicate a state if a change in state occurs for either the access control system or alarm system. For example, in a scenario wherein the lockset is locked and the alarm system is armed and subsequently the user unlocks the lockset, the indicator may indicate that the alarm system is armed. This may occur only when the lockset is locked and the alarm system is armed. In some embodiments, the indicator may be constructed as an auditory indicator. In this embodiment, if the authorized user unlocks the lockset but fails to notice that the alarm is still armed, the access control system (which, as noted above, may also be referred to as a lockset system) may audibly emit a voice saying "Caution System Still Armed" or similar. The lockset system may also emit a voice signal indicating that a false alarm could occur if the door is opened. In some embodiments, the lockset system may audibly emit a voice signal prompting the user to disarm the system, such as "Enter PIN to Avoid False Alarm" or similar. Accordingly, the lockset system may also permit the user to enter a valid credential through the authentication device to disarm the alarm system, and the lockset system may audibly emit a voice signal confirming the new state of the disarmed alarm system, such as "System Disarmed" or similar. While some examples of voice phrases are disclosed herein, any suitable phrase or word may be employed to convey information as described above.

In some embodiments, an auditory indicator may provide a state message when a valid credential is input by the user at the authentication device by audibly emitting a voice signal containing words indicating whether the alarm system is armed or disarmed (e.g., "Armed", "Disarmed", "Protected", "Unprotected", etc.). In an alternative embodiment, the lockset system may audibly emit the state of the lockset system and/or alarm system when the lockset is locked without the use of the authentication device. For example, a user may use a one-touch locking button 34 to lock the lockset without using the authentication device, which may trigger the audible emission of the state of the lockset system and/or alarm system. In this embodiment, the auditory indicator may be further configured to audibly emit a voice signal containing words indicating that a user may arm or disarm the alarm system (e.g., "Do You Want to Arm the System?", "Do You Want to Disarm the System?", etc.) depending on the particular states of the lockset system and alarm system.

In a scenario wherein the alarm system is disarmed and the user locks the lockset, the auditory indicator may audibly emit a voice signal containing words indicating that the alarm system is disarmed, and further audibly emit a voice signal containing words indicating that a user may arm the alarm system. The access control system may also indicate that it was unable to arm the system due to an error in arming, and emit a voice signal containing words indicating to the user the error preventing the alarm system from arming. The user may enter a valid credential at the authentication device, so that the controller arms the alarm system. The auditory indicator may then audibly emit a voice signal containing words indicating that the alarm system is armed, such as "Welcome Home—Your System Has Been Armed on Valid PIN". In an alternative scenario wherein the alarm system is armed and the user unlocks the lockset, the auditory indicator may audibly emit a voice signal containing words indicating that the alarm system is armed, and further audibly emit a voice signal containing words indicating that a user may disarm the alarm system. The user may then enter a valid credential at the authentication device to disarm the system, so that the controller disarms the alarm system. The auditory indicator may then audibly emit a voice signal containing words indicating and confirming that the alarm system is disarmed, such as "Welcome Home—Your System Has Been Disarmed on Valid PIN".

In some embodiments, the lockset system may only provide the state of the alarm system, and not allow an authorized user to change the state of a cooperating alarm system. In this embodiment, when the user accesses the alarm system at the authentication device at the door, optionally by a one-touch button or icon, the user may enter a valid credential through the authentication device. The lockset system may then audibly emit a voice signal containing words indicating whether the alarm system is armed or disarmed, such as "System Armed" or "System Disarmed" depending on the alarm system state. In such an arrangement, the lockset system may not further prompt the user to change the state of the cooperating alarm system.

In an alternative embodiment, the lockset system may provide the state of the alarm system, and always prompt an authorized user to change the state of a cooperating alarm system. For example, if the alarm system is initially in a disarmed state and the lockset is locked by the user, optionally by one-touch locking, the lockset system may emit from the auditory indicator a voice signal containing words indicating that a user may arm the alarm system, such as "Would You Like to Arm the System?" or similar. The lockset system then may permit the user to verify a valid credential through the authentication device to arm the alarm system. Subsequently, the auditory indicator may emit a voice signal containing words indicating that the alarm system is armed, such as "System Armed" and, optionally, words indicating that the lockset is locked, such as "Door Locked" or similar.

Figure 4:
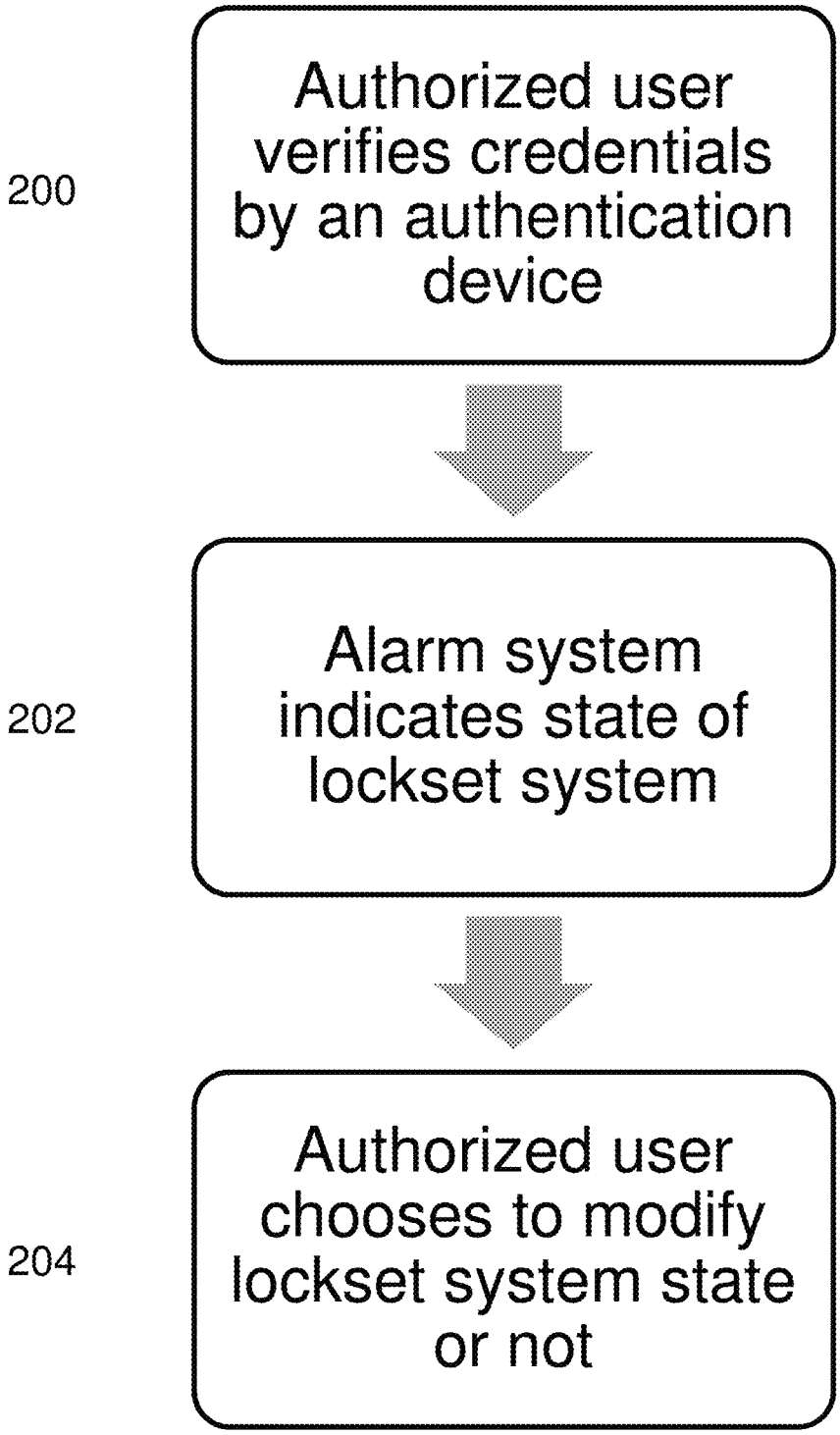

FIG. 4 is a flowchart of one embodiment of a method of operating the alarm system to receive and change a state of a cooperating lockset system. In this embodiment, at box 200, an authorized user first verifies a valid credential by an authentication device located on an alarm system control panel. The authentication device may comprise a keypad, RFID scanner, biometric scanner, or any of the other authentication devices identified above suitable for verifying a valid credential for an authorized user. Following the verification of the user credentials, at box 202, the alarm system may indicate, as noted above, the state of the lockset system by visual, auditory, or haptic indicator. Subsequently, at box 204, the authorized user may choose to change the state of the lockset system or leave the state unmodified. The user may alter the state of the lockset system by the authentication device or other suitable element located on the alarm system control panel.

In some embodiments, the alarm system may prompt the user if certain pre-defined state criteria of the lockset system and/or alarms system are met. For example, the alarm system may prompt the user to lock a lockset of a lockset system when in an unlocked state, or unlock a lockset of a lockset system when in a locked state. Furthermore, multiple conditionals may be employed to cause a prompt for the user to change the state of the lockset system and/or alarm system. For example, the arming of an alarm system wherein one or more locksets of cooperating lockset systems are unlocked may cause the alarm system to prompt the user to lock the unlocked locksets.

In some cases, one or more users may be authorized to operate the lockset system and alarm system. Accordingly, it may be desirable for a remote authorized user to be notified of a change in state of the lockset system and/or alarm system and change the state of the lockset system and/or alarm system in view of that state change. For example, a parent who is an authorized user with a child who is also an authorized user may wish to receive an indication of a change of state when the child arrives at home (e.g., when the child enters the home and disarms the alarm). In this example, the child may forget to lock the lockset or rearm the alarm upon entering the home, compromising the security of the protected space of the home. Accordingly, the parent may wish to change the state of the lockset system remotely to secure the protected space by locking the lockset or arming the alarm system. In a similar example, a parent who is an authorized user with a child who is also an authorized user may wish to receive an indication of a change in state of the lockset system when the child arrives at home to prevent a possible false alarm. In this example, the child may forget to disarm the alarm system upon entering the protected space of the home, which may trigger a false alarm if left unattended for long. Accordingly, the parent may wish to be notified of the state change of the lockset system (i.e. lockset changing from locked to unlocked) by the child and subsequently change the state of the alarm system to a disarmed state remotely, thereby avoiding a false alarm.

Figure 5:
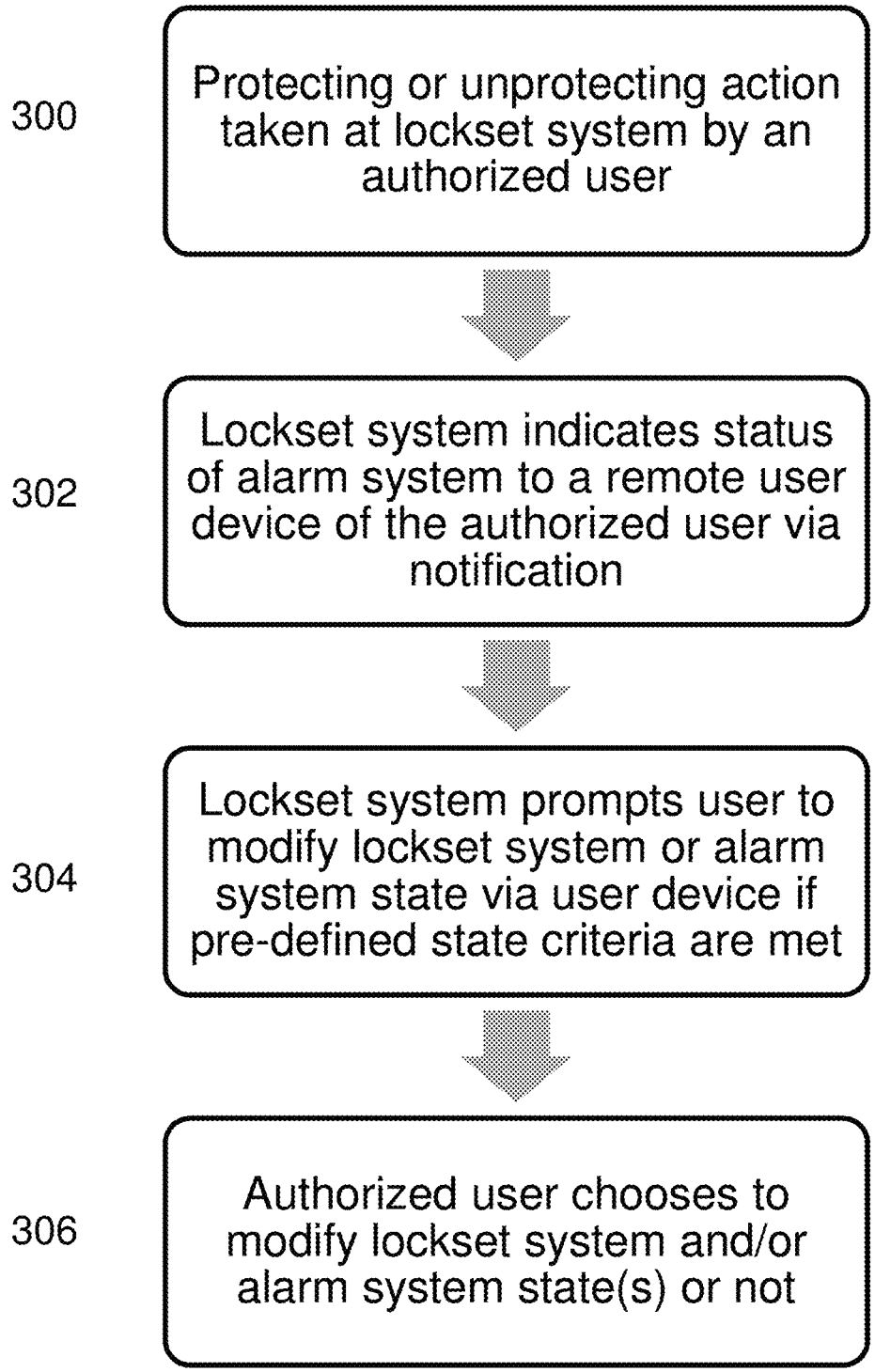

FIG. 5 is a flowchart of one embodiment a method of operation of a lockset system via a remote user device. In this embodiment, at box 300, a protecting or unprotecting action is taken at the lockset system by an authorized user. Subsequently, at box 302, the lockset system may indicate the state of a cooperating alarm system via a visual, auditory, or haptic notification to a remote user device, as noted above. The remote user device may be any suitable device arranged to receive a notification, including but not limited to a computer or smartphone. The remote device may be connected to the Internet, by which an Internet-connected lockset system can transmit the indication to the remote device. Any conventional data protocols may be used for such a transmission, and the present disclosure is not limited to a particular type. In some embodiments, the transmission may be received by an application on the remote device and cause a visual, auditory, or haptic indicator to indicate a state change of lockset system and/or cooperating alarm system. Following the indication of state change, at box 304, the lockset system may transmit a prompt to the remote user device to change the state of the lockset and/or alarm system if certain pre-defined criteria are met. The pre-defined criteria may be included in a standard lockset system, or customizable by an authorized user. The criteria may include a particular state of a lockset system and/or alarm system and other conditions like time of day, user identity, etc. At box 306, the authorized user may then choose to change the lockset system and/or alarm system state via the remote device based on the notification and prompt.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A combined access control system and alarm system, the alarm system configured to detect an unauthorized access into a protected space, the combined access control system and alarm system comprising:

an alarm system control panel having a user interface and an alarm system controller, the alarm system controller configured to control the alarm system between an armed state and disarmed state;

a lockset disposed on a door and including a latch constructed and arranged to change between a locked state and an unlocked state to correspondingly lock or unlock an access point;

a lockset controller in communication with the alarm system controller and the lockset, wherein the lockset controller is physically separate from the alarm system control panel, wherein the lockset controller is constructed and arranged to receive an input commanding the alarm system controller to change the state of the alarm system, and wherein the alarm system controller is configured to indicate the state of the latch;

a lockset authentication device in communication with the lockset controller to allow a user to change the lockset between the locked state and the unlocked state after input of a valid credential to the lockset authentication device.

2. The access control system of claim 1, wherein the lockset controller is constructed and arranged to receive the input from the lockset authentication device commanding the alarm system controller to change the state of the alarm system.

3. The access control system of claim 1, wherein the lockset controller is constructed and arranged to command the alarm system controller to change the state of the alarm system after input of a valid credential to lock or unlock the latch.

4. The access control system of claim 1, wherein the lockset controller is constructed and arranged to prompt the user to change the state of the alarm system after input of a valid credential to lock or unlock the latch.

5. The access control system of claim 4, wherein the lockset controller is constructed and arranged to emit an auditory prompt to the user to change the state of the alarm system after input of a valid credential to lock or unlock the latch, wherein the prompt comprises a voice signal containing words indicating: a) that the alarm system should be armed, b) that the alarm system should be disarmed, c) that a user may arm the alarm system, and/or d) that a user may disarm the alarm system.

6. The access control system of claim 5, wherein the prompt comprises a voice signal containing words indicating that the alarm system should be armed and/or that the user may arm the alarm system.

7. The access control system of claim 1, further comprising a lockset indicator communicating with the lockset controller, the lockset indicator constructed and arranged to indicate a state of the alarm system to a user after input of the valid credential, wherein the indicator is at least one of a visual, auditory, and haptic indicator.

8. The access control system of claim 7, wherein the indicator is an auditory indicator and wherein the lockset controller commands the indicator to audibly emit a voice signal containing words indicating whether the alarm system is armed or disarmed.

9. The access control system of claim 8, wherein the voice signal is pre-recorded.

10. The access control system of claim 8, wherein the lockset is an electronic lockset.

11. The access control system of claim 10, wherein the electronic lockset comprises a motor, wherein the motor is constructed and arranged to move the latch between the locked state and the unlocked state.

12. The access control system of claim 11, wherein after input of a valid credential to the lockset authentication device, the lockset controller commands the latch to lock or unlock.

13. The access control system of claim 8, wherein the lockset is a manual lockset.

14. The access control system of claim 8, wherein the lockset authentication device is positioned within the protected space.

15. The access control system of claim 8, wherein the lockset authentication device is positioned outside the protected space.

16. The access control system of claim 7, wherein at least one of the lockset authentication device and lockset indicator is disposed on remote device.

17. The access control system of claim 7, wherein the lockset indicator and the lockset authentication device is a GUI on a personal computing device.

18. The access control system of claim 1, wherein the lockset authentication device includes a one-touch lock button for locking the door.

19. The access control system of claim 1, wherein the alarm system controller is configured to indicate the state of the latch after input of a valid credential to the alarm system controller.

20. The access control system of claim 1, wherein the lockset controller is constructed and arranged to receive a signal from the alarm system controller, wherein the signal causes the lockset controller to command the lockset to change the latch between a locked and unlocked state after input of a valid credential to the alarm system controller.

21. A combined access control system and alarm system, the alarm system configured to detect an unauthorized access into a protected space, the combined access control system and alarm system comprising:

an alarm system control panel having a user interface, an alarm system controller, and an alarm system indicator, wherein the alarm system controller is configured to control the alarm system between an armed state and disarmed state;

a lockset disposed on a door and including a latch constructed and arranged to change between a locked state and an unlocked state to correspondingly lock or unlock an access point;

a lockset controller in communication with the alarm system controller and the lockset, wherein the lockset controller is physically separate from the alarm system control panel, and wherein the lockset controller is configured to allow a user to change the lockset between the locked state and the unlocked state after receipt of an authorized input, wherein the lockset controller is configured to indicate a state of the alarm system to a user after receipt of the authorized input; and a lockset authentication device in communication with the lockset controller configured to provide the authorized input to the lockset controller after input of a valid credential to the lockset authentication device;

wherein the lockset controller is configured to receive an input commanding the alarm system controller to change the state of the alarm system after the state of the alarm system is indicated by the lockset controller, wherein the alarm system controller is configured to indicate the state of the latch after entry of a valid credential to the alarm system controller, and wherein the alarm system controller is configured to receive an input commanding the lockset system controller to change the state the latch after the state of the latch is indicated by the alarm system controller.

22. The access control system of claim 21, wherein the lockset controller is constructed and arranged to emit a prompt to the user to change the state of the alarm system after receipt of the authorized input, wherein the prompt comprises a voice signal containing words indicating that the alarm system should be armed and/or that a user may arm the alarm system.

23. The access control system of claim 22, wherein the lockset controller is configured to receive an input to arm the alarm system after the lockset controller emits a prompt to the user.

* * * * *